US006045491A

United States Patent [19]

McNergney et al.

[11] Patent Number: 6,045,491

[45] Date of Patent: Apr. 4, 2000

[54] EXERCISE MACHINE

[75] Inventors: Elyse McNergney, 210 W. 101st St. 14D, New York, N.Y. 10025; Hermann Knippscheer, Baldwin, N.Y.

[73] Assignee: Elyse McNergney, New York, N.Y.

[21] Appl. No.: 09/144,286

[22] Filed: Aug. 31, 1998

[51] Int. Cl.[7] ..... A63B 69/06

[52] U.S. Cl. ..... 482/121; 482/72; 482/69

[58] Field of Search ..... 482/72, 70, 69, 482/71, 121, 123, 73

[56] References Cited

U.S. PATENT DOCUMENTS

| | | | |
|---|---|---|---|
| 2,397,054 | 3/1946 | Segalla | 482/72 |
| 2,773,499 | 12/1956 | Nieden . | |
| 5,066,005 | 11/1991 | Luecke | 482/96 |

*Primary Examiner*—Jerome W. Donnelly

*Attorney, Agent, or Firm*—R. Neil Sudol; Henry D. Coleman

[57] ABSTRACT

An exercise machine has a frame, a carriage movably mounted to the frame for motion along a substantially linear path and a plurality of springs on the frame for spring biasing the carriage in one direction along the path A latch mechanism is mounted to the frame and is operatively connected to the springs for selectively coupling the springs between the frame and the carriage, thereby providing a variable amount of resistance to motion of the carriage. The latch mechanism includes a manually actuatable handle extending laterally from the carriage, thereby facilitating an adjustment in the resistance to carriage motion, and further includes a spindle and a hook. The spindle is rigid at one end with the handle and, at a point spaced from the handle, with the hook. The spindle, together with the handle and the hook, is swivelable about, and reciprocatable along, an axis. A spring member is disposed on the frame for biasing the hook into a spring-coupling position. The exercise machine also include adjustable shoulder rests and adjustable foot stops. The carriage is mounted to avoid derailment and a pair of ropes have equally adjustable effective lengths.

19 Claims, 7 Drawing Sheets

EXERCISE MACHINE

BACKGROUND OF THE INVENTION

This invention relates to an exercise machine. More specifically, this invention relates to an exercise machine of the type wherein a platform or carriage is movable mounted to a frame and spring biased in one direction along a path of motion.

Exercise machines are well known in which a platform is supported for reciprocating motion along horizontal tracks on a frame. The platform is connected by springs to one end of the frame. The springs provide a resistive force against motion of the platform in one direction along the tracks and a restorative force aiding motion of the platform in the other direction along the tracks. Typically, a user sits or lies on the platform and pushes with his or her legs against a footbar on the frame In addition, pulley-mounted cords or ropes are connected to the platform for enabling other types of exercises, for example, using the arms, in counteraction to the resistance provided by the springs.

Machines of this type are designed for exercising so called core muscle groups, namely those muscles of the torso which stabilize the person during normal daily activities such as standing, sitting, and walking. These machines enable the stretching of many muscle groups together, without exceeding a normal or natural range of muscle stretching.

Exercise machines of the above-described type are disclosed in U.S. Pat. No. 5,338,278 to Endelman, U.S. Pat. No. 5,066,005 to Luecke, U.S. Pat. No. 4,884,802 to Graham, U.S. Pat. No. 3,892,404 to Martucci, U.S. Pat. No. 3,770,267 to McCarthy, and U.S. Pat. No. 3,586,322 to Kverneland.

Known core-muscle-group exercise machines are generally ill-suited for exceptional individuals, particularly athletes The machines are built for individuals of average size and strength. When such machines are used by persons of extraordinary size and/or strength, the machines are either too small or insufficiently strong. For example, the platform sometimes derails if the forces exerted are too great.

Another disadvantage of conventional core-muscle-group exercise machines lies in the fact that adjustment of the cords or ropes, when accommodating individuals of different sizes, frequently results in unequal effective lengths of the cords or ropes. This inequality or asymmetry in machine action is disadvantageous insofar as muscle strains may result.

Adjusting the spring forces in conventional platform-type exercise machines is generally inconvenient, requiring that the user stop and change position, particularly where a machine is being used in a demonstration to several student users. Depending on the numbers of students and the classroom space, the students frequently cannot witness what adjustments are made. The springs and the adjustment thereof are obscured by the frame of the machine.

All limb movement necessitates trunk muscle recruitment via the reciprocal motion of the machine and user's body weight and spring resistance. Many exercise machines typically cause compressive loading on the spine in vertical positions. This type of loading causes degeneration of the spinal segments. With horizontal exercise machine of the movable platform type, spine, shoulder, hip, knee and ankle stability are ideal benefits which occur during developed or choreographed exercise sequences.

Often back patients exhibit trunk muscle atrophy and poor posture which can be changed by using low spring loading, with submaximal trunk loading as a result. The existing equipment however is not adaptable for the body length or body weight of many professional athletes who need an extreme amount of resistance to effect muscle hypertrophy.

OBJECTS OF THE INVENTION

An object of the present invention is to provide an improved exercise machine of the above-described type.

Another object of the present invention is to provide such an exercise machine which readily accommodates individuals of exceptional dimensions.

It is a further object of the present invention to provide such an exercise machine wherein the chance of derailment of the platform or carriage is significantly reduced, if not eliminated.

An additional object of the present invention is to provide such an exercise machine which facilitates use of the machine in teaching small groups of users.

Another object of the present invention is to provide an apparatus and/or associated exercise method for performing bilateral and unilateral leg press, spine flexion, extension, chest press, biceps curl, etc., in which the user can perform core stabilization routines.

These and other objects of the present invention will be apparent from the drawings and descriptions herein.

SUMMARY OF THE INVENTION

An exercise machine comprises, in accordance with the present invention, a frame, a carriage movably mounted to the frame for motion along a substantially linear path, and a plurality of springs on the frame for spring biasing the carriage in one direction along the path. A latch mechanism is mounted to the carriage and is operatively connectable to the springs for selectively coupling the springs between the frame and the carriage, thereby providing a variable amount of resistance to motion of the carriage. The latch mechanism includes a manually actuatable handle extending laterally from the carriage, thereby facilitating an adjustment in the resistance to carriage motion.

Such an exercise machine is easier to use than conventional machines, insofar as adjustments in the magnitude of spring tension can be effectuated by the user while the user remains supine on the carriage. The machine is particularly useful in class situations because an instructor may demonstrate the use of the machine and particularly how to adjust the total spring resistance or biasing force so that large numbers of students can view the demonstration even while sitting or recumbent on respective machines. It is easier for students to witness and perform the manipulation required to adjust the spring force, when the actuators or handles are located along the outside of the machine, rather than hidden in the frame as in conventional carriage-type exercise machines.

In accordance with another feature of the present invention, the latch mechanism includes a spindle and a hook. The spindle is rigid at one end with the handle and, at a point spaced from the handle, with the hook. The spindle, together with the handle and the hook, is swivelable about, and reciprocatable along,, an axis. Preferably, the handle is one of a plurality of handles included in the latch mechanism, while the spindle is one of a plurality of spindles and the hook is one of a plurality of hooks. The handles all extend laterally from the carriage, and the spindles extend parallel to one another for limited rotation or turning about respective axes. Each of the hooks is rigid with a respective one of the spindles and each of the spindles is connected at one end to a respective one of the handles. The latch mechanism further includes at least one spring member disposed on the frame for biasing the hooks into spring-coupling positions.

Generally, the springs are activated in pairs. To that end each spindle is provided with a pair of hooks spaced from one another for simultaneously and detachably coupling a respective pair of springs on one side to the frame and on an opposite side to the carriage. Where there is an odd number of springs, one of the spindles is provided with only one hook.

Because of the disposition of the handles for adjusting spring tension, the frame may be provided with a casing which encloses the springs.

The exercise machine further comprises a pair of shoulder rests projecting from the carriage. The shoulder rests according to the invention typically take the form of cylindrical pads mounted to respective pins In accordance with the present invention, the shoulder rests are adjustably attached to the carriage for varying a spacing between the shoulder rests.

More specifically, the shoulder rests may be each attached to the carriage via a respective spring loaded pivotable arm. In order to enable use of the carriage in certain exercise where the shoulder rests would interfere with the exercises, the pivotable arm includes a spindle turnable about an axis of the arm. Thus, the respective shoulder rest can be pivoted from a use position projecting upwardly from an upper surface of the carriage to a non-use position disposed below the lower surface of the carriage.

The exercise machine further comprises a pair of flexible tensile members each attached at one end to the carriage and extending around respective pulleys mounted to the frame. In accordance with the present invention, the exercise machine is provided with an adjustment mechanism for adjusting the effective lengths of the flexible tensile members by equal amounts. The adjustment mechanism may include a pair of reels rotatably secured to the carriage, the reels being rigid with one another and rotatable about a common axis, a releasable lock being provided for preventing rotation of the reels. Alternatively, the adjustment mechanism includes a plurality of interspaced stop elements, such as beads, on each of the flexible tensile members and a cooperating stop plate on the carriage. The plate is provided with a slot for receiving the respective flexible tensile member, the slot having a width smaller than the widths or diameters of the stop elements on the respective flexible tensile member.

In accordance with an additional feature of the present invention, foot stops are adjustably supported on the carriage to provide pressing planes at variable positions relative to the carriage. The foot stops are disposed on L-shaped brackets slidably connected to the carriage for adjustment motion in a direction parallel to the path. The L-shaped brackets are each provided with a plurality of notches along a lower edge. The notches are alternately registrable with a lug projecting from the frame.

In accordance with a further feature of the present invention, where the frame includes a pair of rails extending parallel to the path, the carriage is mounted to the rails by a first set of wheels engageable with horizontal surfaces of the rails and a second set of wheels engageable with vertical surfaces of the rails, the second set of wheels being spring biased against the vertical surfaces.

An exercise machine in accordance with the present invention is more versatile than comparable conventional machines and permits the execution of exercise programs designed for specific physiologic benefit to such populations as back patients, seniors, athletes, and the general fitness population. An exercise machine according to the present invention permits the user to perform pull downs and lower and upper extremity movement sequences.

The user of an exercise machine in accordance with the present invention experiences a force as a result of variable motions through variable degrees of freedom, which promotes a range of motion and musculoskeletal strength. The apparatus provides variable resistance exercise primarily for the purpose of musculoskeletal health, spine rehabilitation and athletic core training for injury prevention. Reciprocating motion on the track assembly allows a feedback loop system for heightened proprioception. Neuromuscular education of the spine stabilization system directed towards head-neck, ribcage, pelvis stabilization, strengthening and flexibility addresses kinematic movements of the upper and lower extremities. Activity of the trunk musculature is either tonic (stabilizing) or phasic (moving) during all exercise sequences.

DESCRIPTION OF THE PREFERRED EMBODIMENTS

Figure 1:
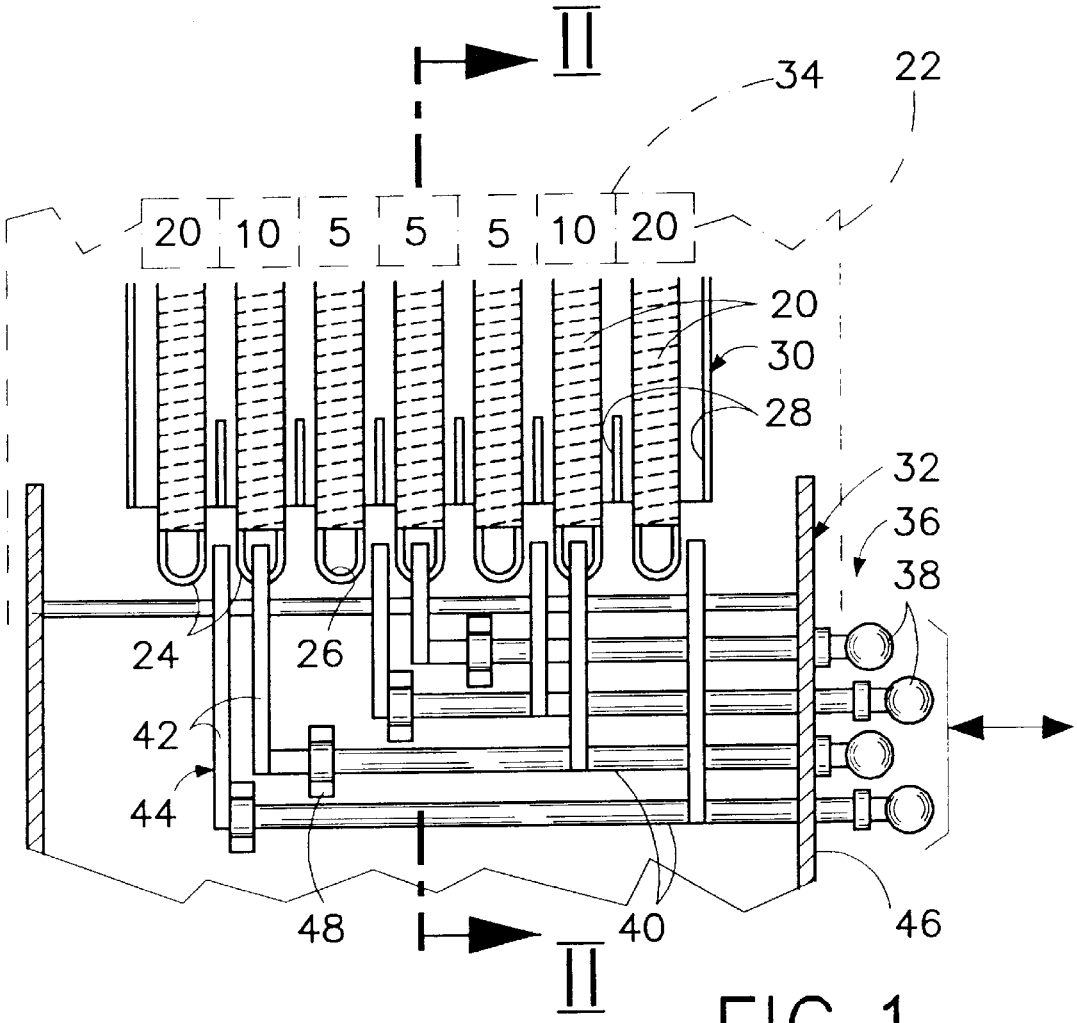
FIG. 1 is partially a schematic top view and partially a schematic horizontal cross-sectional view of an adjustable spring assembly of a core-muscle exercise machine in accordance with the present invention.

As illustrated in FIG. 1, a spring assembly of a core-muscle exercise machine comprises a plurality of helical tension springs 20 each fastened at one end to a frame 22 of the exercise machine and each provided at the opposite end with a loop 24 defining an eyelet 26. Springs 20 are slidably supported in respective channels 28 of a guide rack 30 mounted to machine frame 22. Springs 20 have different spring constants and present different degrees of resistance to motion of a carriage 32 when connected to the carriage. The spring force resisting the motion of carriage 32 along a linear path away from guide rack 30 is variable, for example, from 5 kp to 75 kp in steps of 5 kp. The force exerted by each spring is indicated in a table 34 incorporated into FIG. 1.

A latch mechanism 36 mounted to carriage 32 is operatively connectable to springs 20 for selectively coupling the springs between frame 22 and the carriage, thereby providing a variable amount of resistance to motion of the carriage along its linear translation path. Latch mechanism 36 includes a plurality of manually actuatable handles 38 extending laterally from carriage 32. This positioning of the handles facilitates an adjustment in the resistance to carriage motion.

Latch mechanism 36 further includes a plurality of spindles 40 each rigidly connected at one end to a respective handle 38 and each provided with one or two hooks 42 rigid with the respective spindle. Each spindle 40, together with the respective handle 38 and the respective hook or hooks 42, forms a latching unit 44 reciprocatable along a respective axis extending perpendicularly to the reciprocation path of carriage 32. In addition, each latching unit 44 is swivelable about the respective spindle axis. Spindles 40 are guided in a sidewall 46 of carriage 32 and in a respective bearing 48 mounted to the carriage. Latch mechanism 36 further includes one or more schematically represented spring members 50 disposed on carriage 32 for biasing latching units 44 so that one or more selected hooks 42 are held in engagement with loops 24, in spring-coupling positions. Spring members 50 may take any suitable form such as leaf springs or torsion springs disposed about spindles 40.

All but one of spindles 40 is provided with two hooks 42 which are spaced from one another by a distance corresponding to the distance between two springs 20. Accordingly, springs 20 are generally activated in pairs. To activate a selected spring 20 or pair of springs 20, a corresponding handle 38 is manipulated to rotate the respective latching unit 44 in opposition to the restoring force exerted by springs 50 so that hooks 42 of that latching unit are lifted above loops 24. Then, handle 38 is manipulated to slide the respective latching unit 44 laterally inwardly along the respective spindle axis. When hooks 42 of that latching unit 44 are aligned with loops 24 of the corresponding springs 20, handle 38 and the associated latching unit are allowed to pivot back into a rest position under the restoring force exerted by springs 50. In that rest position, hooks 42 of the shifted latching unit 44 operationally engage respective loops 24 to thereby couple the respective springs 20 to carriage 32.

Figure 3:
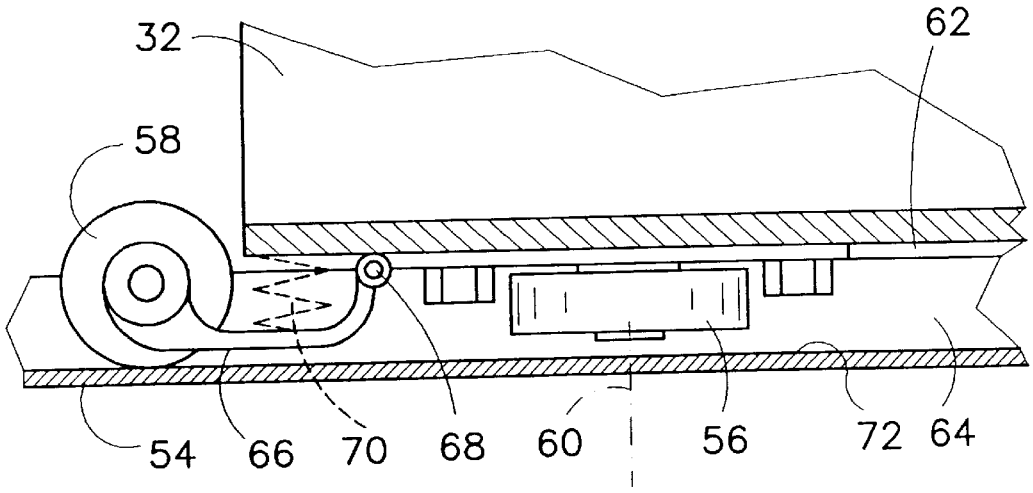
FIG. 3 is partially a schematic top view and partially a schematic horizontal cross-sectional view of a carriage roller guide assembly of a core-muscle exercise machine in accordance with the present invention.
Figure 4:
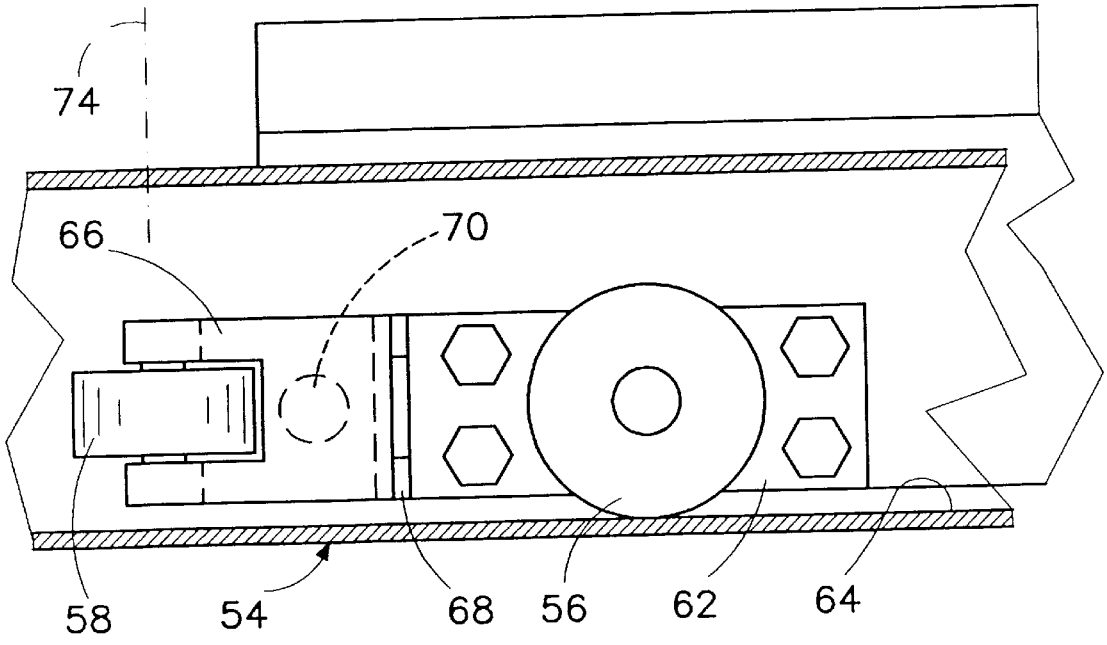
FIG. 4 is partially a schematic side elevational view and partially a schematic vertical cross-sectional view of the carriage roller guide assembly of FIG. 3.

FIGS. 3 and 4 depict one of four roller guide assemblies which rollably mount carriage 32 to a pair of U-shaped rails 54 (only one shown). Each roller guide assembly includes a first wheel 56 and a second wheel 58. Wheel 56 is mounted to carriage 32 via a bracket or base plate 62 for rotation about a respective horizontal axis 60 in engagement with a horizontal surface 64 of rails 54. Wheels 58 are each rotatably mounted to a free end of a respective lever arm 66 in turn pivotably mounted to base plate 62 via a hinge 68. Each lever arm 66 is biased by a compression spring 70 in a laterally outward direction so that the respective wheel 58 is pressed against a vertical surface 72 of rails 54. Wheel 58 rotates about a vertical axis 74.

The roller guide assemblies according to FIGS. 3 and 4 ensure a secure and maintenance free guidance of carriage 32 and prevent the carriage from derailing and wearing against inner surface 72 of rail 54.

Figure 5:
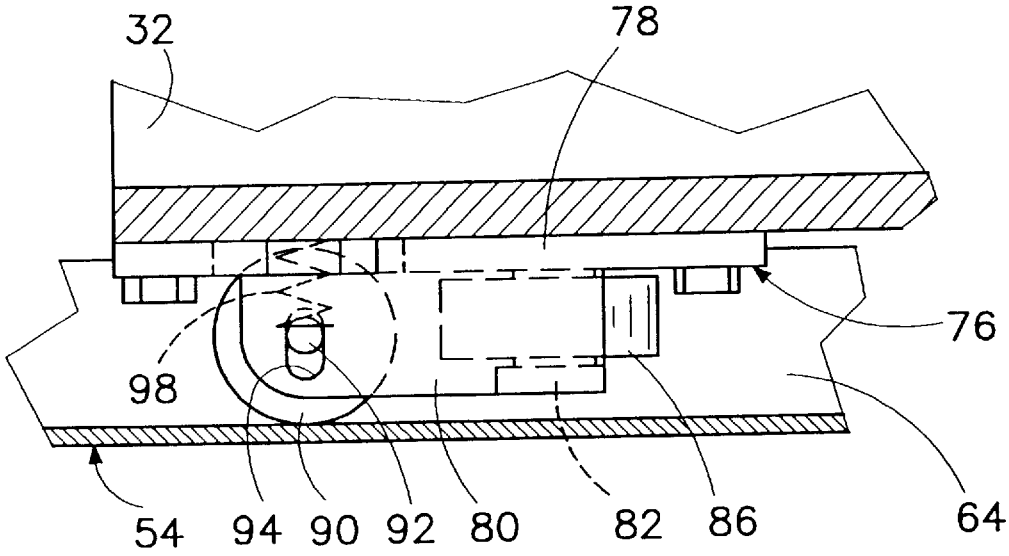
FIG. 5 is partially a schematic top view and partially a schematic horizontal cross-sectional view of another carriage roller guide assembly of a core-muscle exercise machine in accordance with the present invention.
Figure 6:
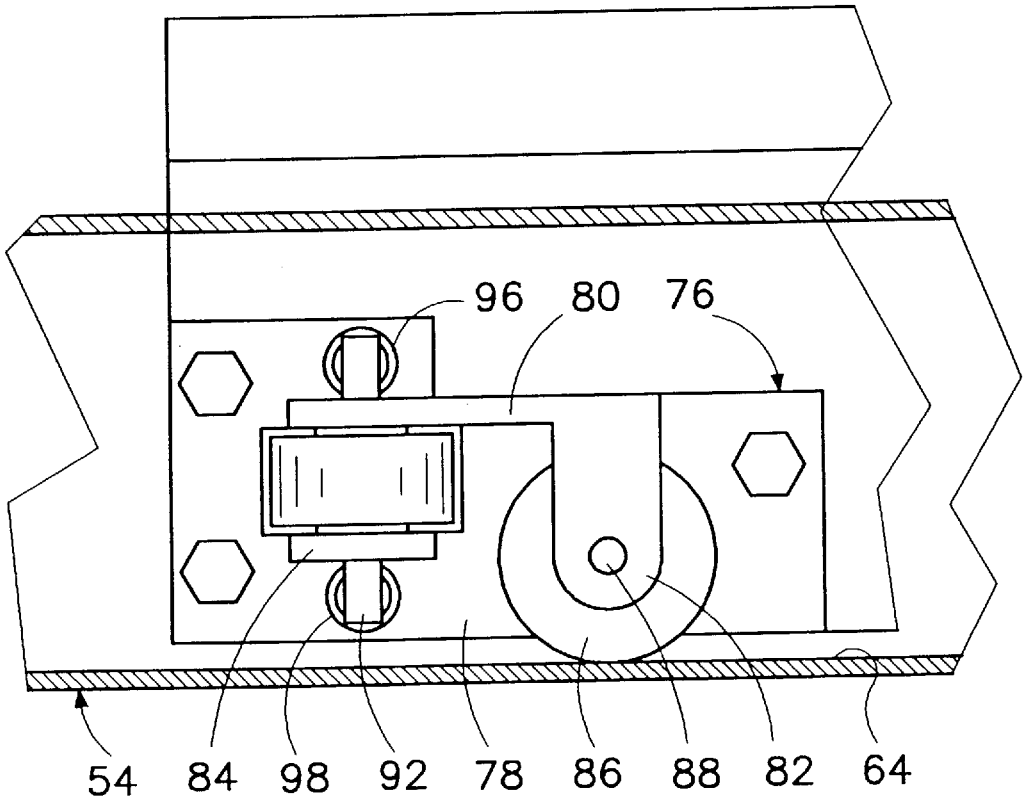
FIG. 6 is partially a schematic side elevational view and partially a schematic vertical cross-sectional view of the carriage roller guide assembly of FIG. 5.

FIGS. 5 and 6 depict an alternative configuration for the roller guide assemblies which mount carriage 32 to rails 54 A bracket 76 includes a base plate 78 attached to carriage 32 and further includes a horizontal plate 80 integral with base plate 78. A finger 82 extends downwardly from horizontal plate 80 and in parallel to base plate 78. Another finger 84 extends horizontally outwardly from base plate 78 in parallel to horizontal plate 80. A first wheel 86, which is rotatably journaled on a pin 88 between base plate 78 and finger 82, rollingly engages horizontal surface 64 of a respective one of rails 54. A second wheel 90 has an axle 92 which traverses slots 94 (only one shown) in horizontal plate 80 and finger 84 and which is biased in a laterally outward direction by a pair of compression springs 96 and 98. Wheel 92 rollingly engages vertical surface 72 of a respective rail 54.

Figure 7:
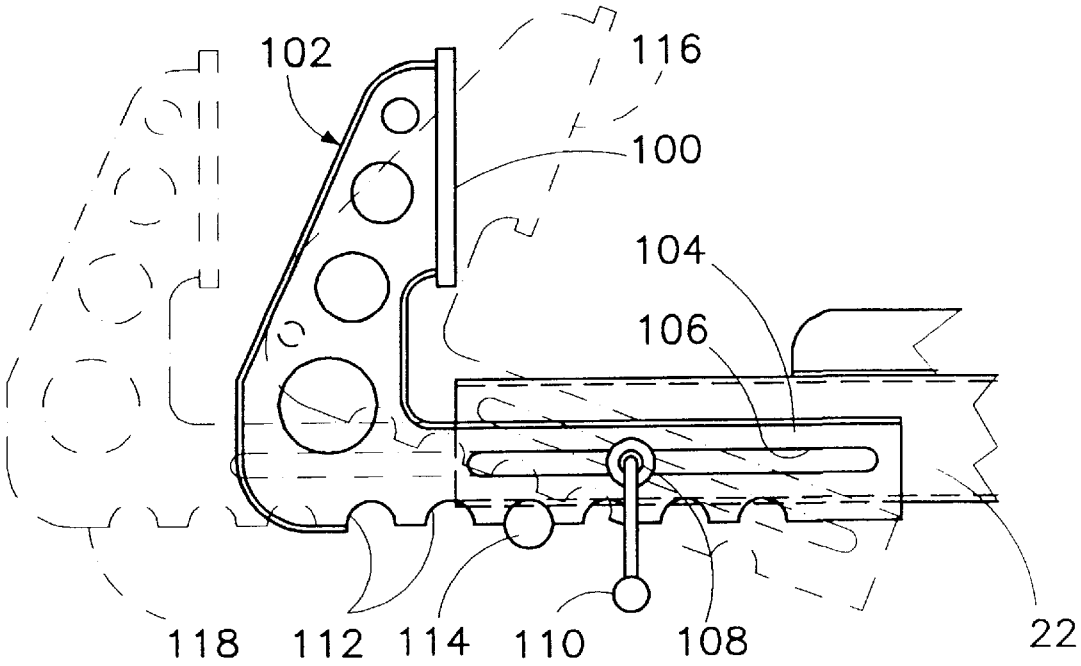
FIG. 7 is a schematic side elevational view of an adjustable foot rest assembly of a core-muscle exercise machine in accordance with the present invention.
Figure 8:
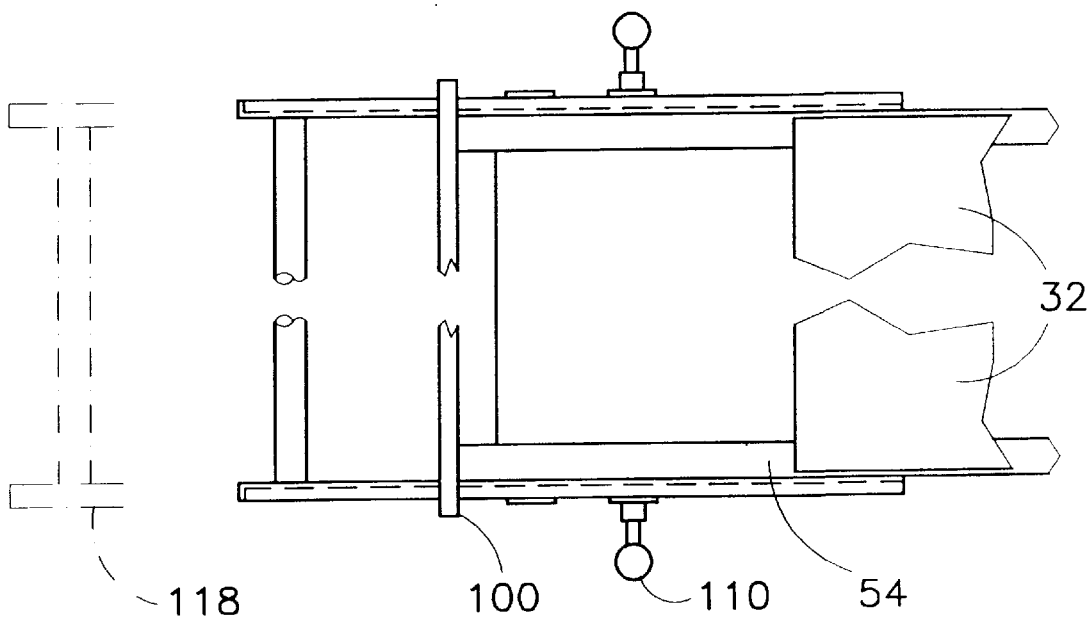
FIG. 8 is a schematic top view of the foot rest assembly of FIG. 7.

As depicted in FIGS. 7 and 8, an adjustable foot support for enabling people of different heights to use the exercise machine includes a planar foot rest or stop 100 connected at opposite ends to a pair of L-shaped brackets or mounting arms 102. Each bracket 102 is provided in one leg 104 with a longitudinally extending slot 106 traversed by a clamping screw 108 having a pivotable actuating handle 110 the clamping screw serving to releasably lock the L-shaped bracket 102 to frame 22 Le, 104 of each bracket 102 is further formed along a lower edge with a plurality of equispaced cutouts or notches 112 which are alternately registrable with a lug 114 projecting laterally from frame 22. During use of the exercise machine, brackets 102 and concomitantly foot rest 100 are supported on lugs 114 at notches 112 selected to adapt the position of the foot rest 100 to the height of the user. To adjust the position of foot rest 100, handles 110 are manipulated to unlock clamping screws 108 and thereby release brackets 102 to enable a pivoting thereof about the clamping screws, as indicated in phantom lines 116 in FIG. 7. Brackets 102 are then slid along clamping screws 108, by virtue of slots 106, to bring selected notches 112 into registration with lugs 114. Brackets 102 are then pivoted in an opposite direction about clamping screws 108 to seat the selected notches 112 on lugs 114. Handles 110 are manipulated to lock brackets 102 to frame 22. Phantom lines 118 indicate another position of brackets and foot rest 110 relative to frame 22.

Figure 9:
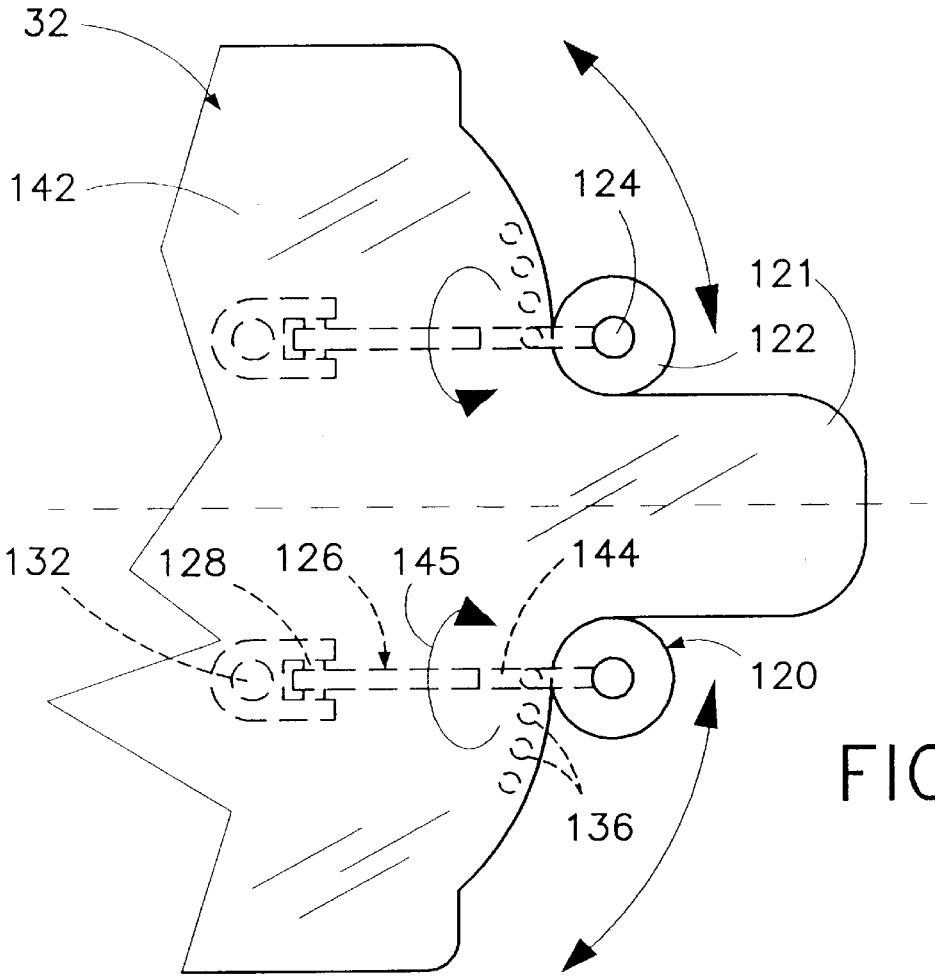
FIG. 9 is a top view of adjustable shoulder rest assemblies of a core-muscle exercise machine in accordance with the present invention.
Figure 10:
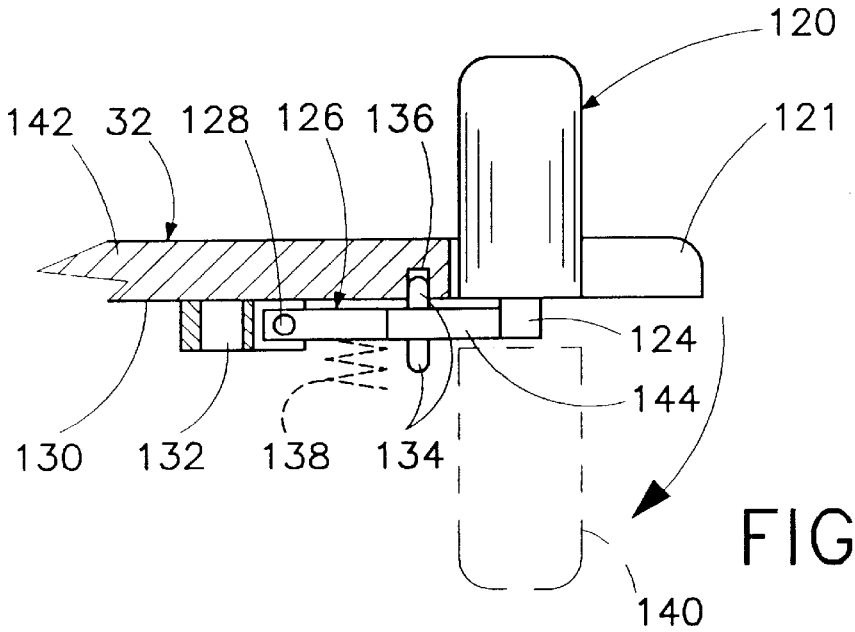
FIG. 10 is partially a schematic side elevational view and partially a schematic vertical cross-sectional view of an adjustable shoulder rest assembly of FIG. 9.

As illustrated in FIGS. 9 and 10, the exercise machine is provided with a pair of shoulder rests 120 each including a cylindrical pad 122 surrounding a support mandrel 124. Shoulder rests 120 are disposed on opposite sides of a headrest extension 121 of carriage 32. Shoulder rests 120 and particularly mandrels 124 thereof are each coupled to carriage 32 via a respective support arm 126. Arm 126 is pivotably attached at a bearing 128 for rotation about a horizontal axis parallel to a lower surface 130 of carriage 32. Bearing 128 in turn is mounted to carriage 32 by a pin 132 for rotation about a vertical axis oriented perpendicularly to lower surface 130. Arm 126 is provided on opposite sides with pegs 134 which are received in any one of a plurality of recesses or holes 136 disposed in a circular array about pin 132. Arm 126 is spring biased in an upward direction towards the lower surface 130 of carriage 32 by a compression spring 138, whereby either peg 134 is held in a selected recess or hole 136.

To adjust the position of a shoulder rest 120, which varies the spacing between the shoulder rests to accommodate a person having a different size neck, the rest is pushed downwardly, in opposition to the biasing force exerted by compression spring 138, so that the respective peg 134 slides out of a recess or hole 136. A lateral force is then exerted on the shoulder rest, to turn arm 126 about pin 132. When peg 134 is aligned with a desired recess or hole 136, the shoulder rest is released to permit the respective peg 134 to move into that recess or hole under the action of spring 138.

The assembly of FIGS. 9 and 10 also permits the shoulder rests 120 to be swung into a non-use or storage position 140. In a use position, shoulder rests 120 extend upwardly from carriage 32, above an upper surface 142 thereof. In the non-use or storage position 140, shoulder rests 120 extend downwardly below lower surface 130, with respective pegs 134 locking the rests in position. To that end, arms 126 each include a spindle portion 144 which is rotatable about a longitudinal axis of the respective arm 126, as indicated by arrows 145.

Figure 2:
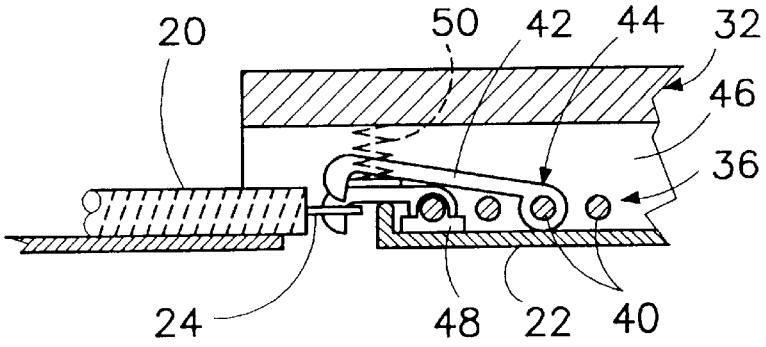
FIG. 2 is partially a schematic side elevational view and partially a schematic vertical cross-sectional view, taken along line II—II in FIG. 1, of the adjustable spring assembly of FIG. 1.
Figure 12:
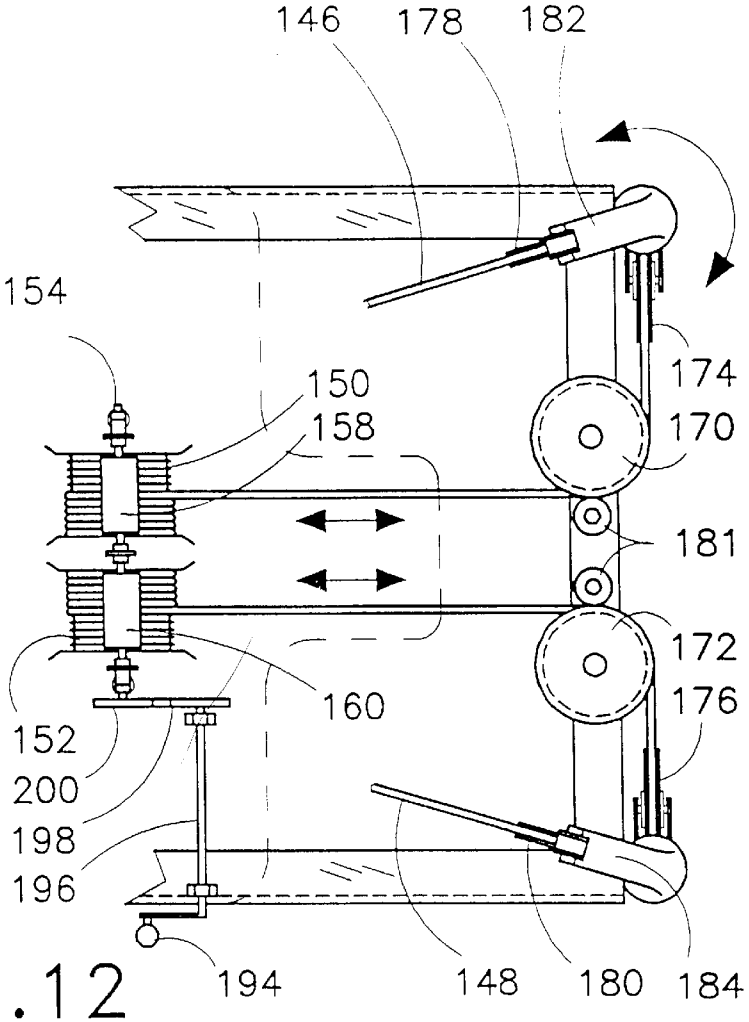
FIG. 12 is a schematic top plan view of the rope deployment assembly of FIG. 11.
Figure 11:
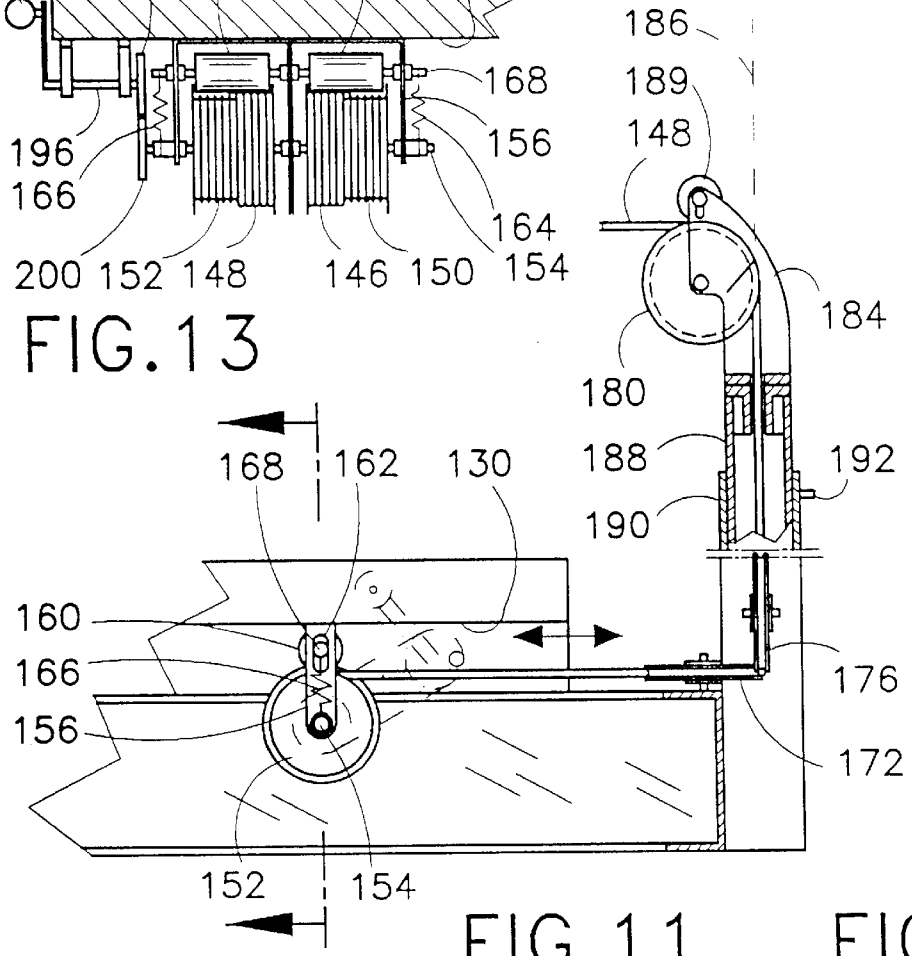
FIG. 11 is a schematic side elevational view and partially a vertical cross-sectional view of a rope deployment assembly of a core-muscle exercise machine in accordance with the present invention.
Figure 13:
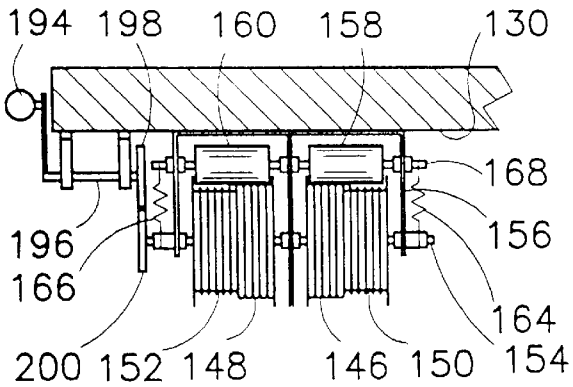
FIG. 13 is partially a schematic front elevational view and partially a schematic vertical cross-sectional view of a double reel included in the rope deployment assembly of FIGS. 11 and 12.

FIGS. 11–13 depict a rope or cord deployment assembly of a core-muscle exercise machine. This assembly provides a means a user to work his or her arms against the resistance of springs 20 (FIGS. 1–2) and comprises two flexible tensile elements in the form of ropes, cords or cables 146 and 148 each anchored at one end to a respective reel or sheave 150 or 152 which is rotatably mounted to lower surface 130 of carriage 32. Reels 150 and 152 are rigidly connected to one another and to an axle 154 which is journaled in three brackets 156 extending downwardly from lower surface 130. Also rotatably journaled between adjacent pairs of brackets 156 are a pair of rollers 158 and 160 which are axially substantially coextensive with respective reels 150 and 152. Rollers 158 and 160 are slidably mounted to brackets 156 via slots 162 provided therein. In addition, rollers 158 and 160 are biased by tension springs 164 and 166 into a pressing engagement with portions of cords 146 wound about reels 150 and 152. Tension springs 164 and 166 are connected at one end to an axle 168 on which rollers 158 are rotatably disposed. At an opposite end, springs 164 and 166 are connected to axle 154 of reels 150 and 152. Spring-loaded rollers 158 and 160 prevent cords 146 and 148 from jumping off of reels 150 and 152 particularly when the cords are not being used.

From reels 150 and 152, cords 146 and 148 extend to respective first pulleys 170 and 172 rotatably mounted to frame 22. In passing partially around pulleys 170 and 172, cords 146 and 148 change their orientation by 90° in a horizontal plane. From first pulleys 170 and 172, cords 146 and 148 extend to respective secondary pulleys 174 and 176 rotatably mounted to frame 22 for enabling another 90° change in the directions or orientations of cords 146 and 148, this time in a vertical plane. From secondary pulleys 174 and 176, cords 146 and 148 extend to respective additional pulleys 178 and 180 which are rotatably mounted to respective guide arms 182 and 184 which can be turned about vertical axes 186 (only one shown). Idler rollers 187 and 189 are provided for maintaining cords 146 and 148 in contact with the respective pulleys 170, 172, 174, 176, 178, 180.

Guide arms 182 and 184 are swivelably mounted to upper ends of respective inner tubular members 188 which are telescopingly received into upper ends of respective outer tubular members 190 integral with frame 22. Locking pins 192 or other locking devices are provided for releasably securing inner tubular members 188 to outer tubular members 190, thereby enabling a user to adjust the heights of pulleys 178 and 180.

Once the heights of pulleys 178 and 180 are properly set by sliding inner tubular members 188 relative to outer tubular members 190, the user may manipulate a handle 194 to partially wind or unwind cords 140 and 148 onto or from reels 150 and 152, thereby adjusting the effective lengths of cords 146 and 148, i.e., the lengths of those portions of cords 146 and 148 extending freely of reels 150 and 152. Handle 194 is connected to a shaft 196 which is rotatably secured to carriage 32 and which is provided at its inner end with a gear 198 meshing with a gear 200 connected to axle 154. Alternatively, gears 198 and 200 could be replaced by a chain-type transmission.

Figure 14:
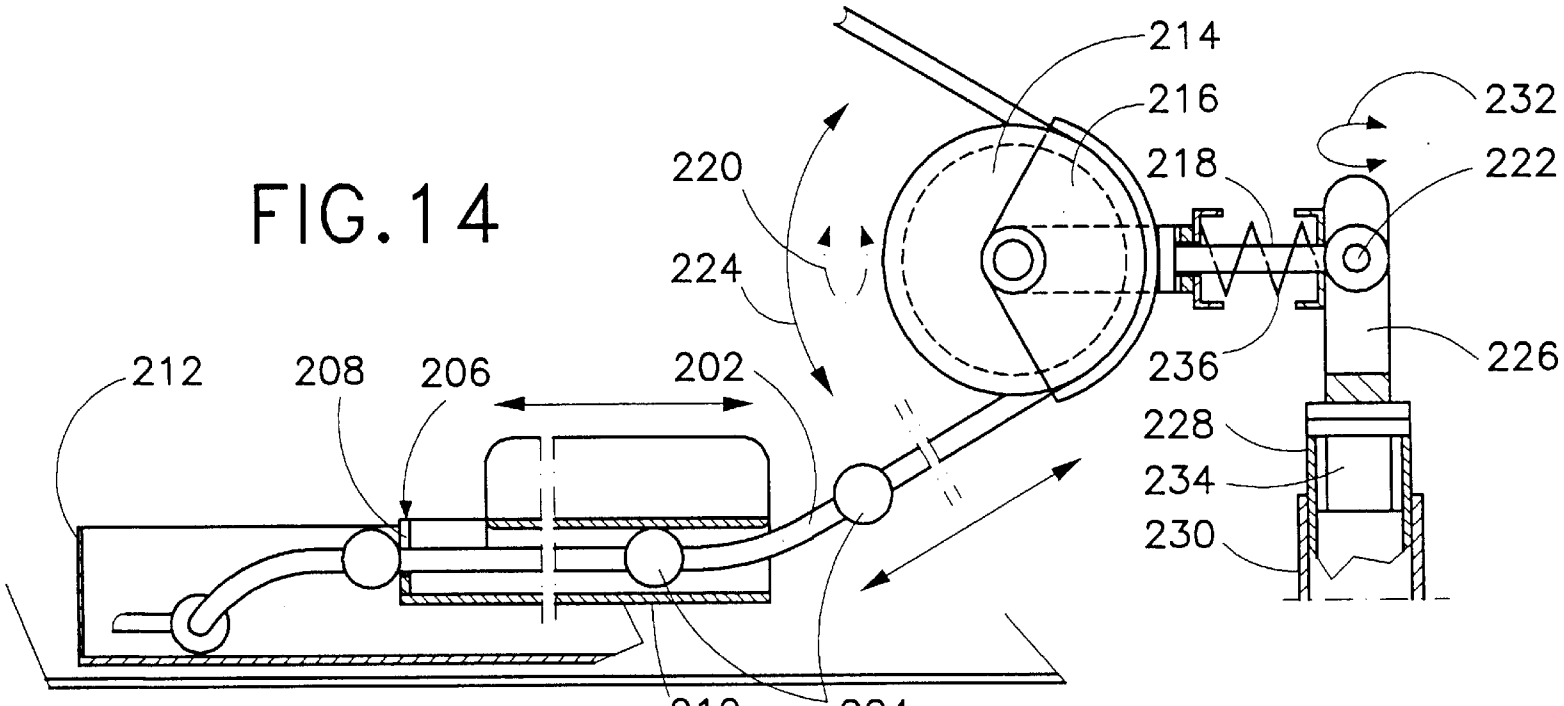
FIG. 14 is partially a schematic side elevational view and partially a schematic vertical cross-sectional view of an alternative rope deployment assembly of a core-muscle exercise machine in accordance with the present invention.
Figure 16:
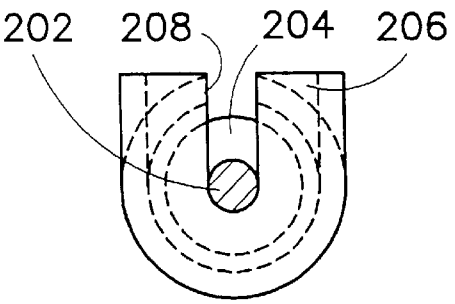
FIG. 16 is a partial front elevational view of a stopper plate included in the rope deployment assembly of FIGS. 14 and 15.
Figure 15:
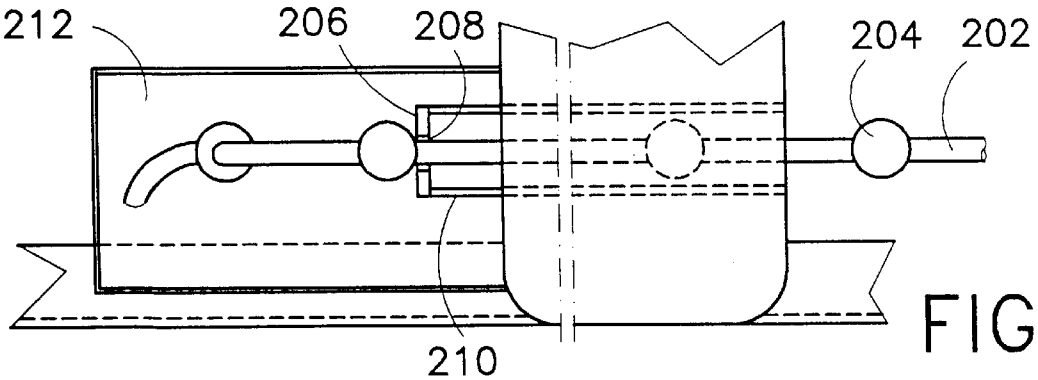
FIG. 15 is a partial top plan view of the rope deployment assembly of FIG. 14

FIGS. 14–16 depict an alternative design for effecting equal changes in the lengths of a pair of ropes, cords or cables 202 (only one shown). Each cord 202 is provided at one end with a multiplicity of equispaced stop balls or beads 204. A cooperating stop plate 206 disposed on the underside of carriage 32 is formed with a slot 208 for receiving the respective cord 202, slot 208 having a width smaller than the diameters of stop balls 204 and wider than the respective cord 202. Stop plate 206 is provided at one end of a channel member 210 through which cord 202 passes. A pair of containers 212 (only one shown) are attached to carriage 32 for holding excess length of respective cords 202.

Cords 202 each extend from channel member 210 to a single pulley 214 journaled between a pair of guide plates 216 which are attached to one end of a spindle 218. Spindle 218 is rotatable about its own axis, as indicated by double-headed arrow 220, and is pivotable about a pin or bearing element 222, as indicated by double-headed arrow 224. Pivot pin 222 is mounted to a holder 226 which is rotatable mounted to an inner telescoping member 228 in turn inserted into an outer telescoping member 230 fixed to machine frame 22. As indicated by a double-headed arrow 292, holder 226, and consequently pulley 214 and guide plates 216, can be swiveled in opposite directions about a bearing post 234 which is inserted into an upper end of inner telescoping member 228.

A compression spring 236 serves to return spindle 218 to a substantially horizontal position when no tension is placed on cord 202.

Once the height of pulley 214 is properly set by sliding inner telescoping member 228 relative to outer telescoping member 230, the user may adjust the effective lengths of cords 202 by placing a selected stop ball 204 in engagement with stop plate 206. The stop balls may be color coded or otherwise identified so that the different cords 202 can be set at the same effective length.

Although the invention has been described in terms of particular embodiments and applications, one of ordinary skill in the art, in light of this teaching, can generate additional embodiments and modifications without departing from the spirit of or exceeding the scope of the claimed invention. For example, for adjusting the spacing between the shoulder pads, the locking of the pivotable arms to the carriage may be effectuated by a peg which is slidably attached to the shoulder pad mounting arm. Other locking devices will be apparent to those skilled in the art.

Accordingly, it is to be understood that the drawings and descriptions herein are proffered by way of example to facilitate comprehension of the invention and should not be construed to limit the scope thereof.

What is claimed is:

1. An exercise machine comprising:

a frame;

a carriage movably mounted to said frame for motion along a substantially linear path;

a plurality of springs on said frame; and a latch mechanism mounted at least in part to said carriage and operatively connectable to said springs for selectively coupling said springs between said frame and said carriage, thereby providing a variable amount of resistance to motion of said carriage, said latch mechanism including a manually actuatable handle extending laterally from one of said carriage and said frame, thereby facilitating an adjustment in the resistance to carriage motion.

2. The machine defined in claim 1 wherein said latch mechanism includes a spindle and a hook, said spindle being rigid at one end with said handle, said hook being rigid with said spindle at a point spaced from said handle, said spindle together with said handle and said hook being translatably and rotatably mounted to said carriage.

3. The machine defined in claim 2 wherein said handle is one of a plurality of handles included in said latch mechanism, said spindle is one of a plurality of spindles included in said latch mechanism, and said hook is one of a plurality of hooks included in said latch mechanism, said handles all extending laterally from said carriage, said spindles extending parallel to one another, each of said hooks being rigid with a respective one of said spindles and each of said spindles being connected at one end to a respective one of said handles, said spindles together with said handles and said hooks being translatably and rotatably mounted to said carriage.

4. The machine defined in claim 3 wherein each of said spindles together with the respective one of said handles and at least one of said hooks is a latching element swivelable about and reciprocatable along a respective axis, said latch mechanism further including at least one spring member disposed on said carriage and biasing said latch element into a spring-coupling position.

5. The machine defined in claim 3 wherein at least one of said spindles is provided with a pair of hooks spaced from one another for simultaneously and detachably coupling a pair of springs on one side to said frame and on an opposite side to said carriage.

6. The machine defined in claim 1, further comprising a pair of shoulder rests projecting from said carriage, said shoulder rests being adjustably attached to said carriage for varying a spacing between said shoulder rests.

7. The machine defined in claim 6 wherein said shoulder rests are each attached to said carriage via a respective spring loaded pivotable arm.

8. The machine defined in claim 7 wherein said carriage has an upper surface and a lower surface, said pivotable arm including a spindle turnable about an axis of said arm, whereby the respective shoulder rest can be pivoted from a use position projecting upwardly from said upper surface to a non-use position disposed below said lower surface.

9. The machine defined in claim 1, further comprising a pair of flexible tensile members each attached at one end to said carriage and extending around respective pulleys mounted to said frame, further comprising adjustment means for adjusting effective lengths of said flexible tensile members by equal amounts.

10. The machine defined in claim 9 wherein said adjustment means includes a pair of reels rotatably secured to said carriage, said reels being rigid with one another and rotatable about a common axis, said adjustment means further comprising a releasable lock for preventing rotation of said reels.

11. The machine defined in claim 9 wherein said adjustment means includes a plurality of interspaced stop elements on each of said flexible tensile members and a pair of cooperating stop plates on said carriage, each of said plates being provided with a slot for receiving the respective flexible tensile member, said slot being narrower than the stop elements on the respective flexible tensile member.

12. The machine defined in claim 1, further comprising a foot stop adjustably supported on said frame to provide a pressing plane at variable positions.

13. The machine defined in claim 12 wherein said foot stop is mounted to substantially L-shaped brackets slidably and pivotably connected to said frame for adjustment in a direction parallel to said path, said L-shaped brackets each being provided with a plurality of notches along a lower edge, said notches being alternately registrable with a lug projecting from said frame.

14. The machine defined in claim 1 wherein said frame includes a pair of rails extending parallel to said path, said carriage being mounted to said rails by a first set of wheels engageable with horizontal surfaces of said rails and a second set of wheels engageable with vertical surfaces of said rails, said second set of wheels being spring biased against said vertical surfaces.

15. An exercise machine comprising:

a frame;

a carriage movably mounted to said frame for motion along a substantially linear path;

a plurality of springs on said frame for spring biasing said carriage in one direction along said path; and a pair of shoulder rests projecting from said carriage, said shoulder rests being adjustably attached to said carriage for varying a spacing between said shoulder rests, said shoulder rests each being attached to said carriage via a respective spring loaded pivotable arm.

16. The machine defined in claim 15 wherein said carriage has an upper surface and a lower surface, said pivotable arm including a spindle turnable about an axis of said arm, whereby the respective shoulder rest can be pivoted from a use position projecting upwardly from said upper surface to a non-use position disposed below said lower surface.

17. An exercise machine comprising:

a frame;

a carriage movably mounted to said frame for motion along a substantially linear path;

a plurality of springs on said frame for spring biasing said carriage in one direction along said path;

a pair of flexible tensile members each attached at one end to said carriage and extending around respective pulleys mounted to said frame; and adjustment means operatively connected to said flexible tensile members and said carriage for adjusting effective lengths of said flexible tensile members by equal amounts, said adjustment means including a pair of reels rotatable secured to said carriage, said reels being rigid with one another and rotatable about a common axis, said adjustment means further comprising a releasable lock for preventing rotation of said reels.

18. An exercise machine comprising:

a frame having a pair of rails;

a carriage movably mounted to said frame for motion along said rails; and a plurality of springs on said frame for spring biasing said carriage in one direction along said rails, said carriage being mounted to said rails by a first set of wheels engageable with horizontal surfaces of said rails and a second set of wheels engageable with vertical surfaces of said rails, said second set of wheels being spring biased against said vertical surfaces.

19. An exercise machine comprising:

a frame;

a carriage movably mounted to said frame for motion along a substantially linear path;

a plurality of springs on said frame for spring biasing said carriage in one direction along said path;

a pair of flexible tensile members each attached at one end to said carriage and extending around respective pulleys mounted to said frame; and adjustment means operatively connected to said flexible tensile members and said carriage for adjusting effective lengths of said flexible tensile members by equal amounts, said adjustment means including a plurality of interspaced stop elements on each of said flexible tensile members and a pair of cooperating stop plates on said carriage, each of said plates being provided with a slot for receiving a respective flexible tensile member, said slot being narrower than the stop elements on the respective flexible tensile member.

* * * * *